US007204744B2

(12) United States Patent
Lamprecht et al.

(10) Patent No.: US 7,204,744 B2
(45) Date of Patent: Apr. 17, 2007

(54) HAND-OPERATED MACHINE-TOOL COMPRISING A VIBRATION-DAMPING ROTARY HANDLE

(75) Inventors: Justus Lamprecht, Dusslingen (DE); Joachim Schadow, Dettenhausen (DE); Mario Frank, Hangzhou (CN); Siegfried Keusch, Deizisau (DE); Ulrich Mueller-Boysen, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 59 days.

(21) Appl. No.: 10/528,972

(22) PCT Filed: Jul. 25, 2003

(86) PCT No.: PCT/DE03/02509

§ 371 (c)(1),
(2), (4) Date: Mar. 23, 2005

(87) PCT Pub. No.: WO2004/039541

PCT Pub. Date: May 13, 2004

(65) Prior Publication Data

US 2006/0166613 A1 Jul. 27, 2006

(30) Foreign Application Priority Data

Oct. 18, 2002 (DE) ..... 102 48 866

(51) Int. Cl.
*B24B 23/00* (2006.01)

(52) U.S. Cl. ..... 451/357; 451/359

(58) Field of Classification Search ..... 451/357, 451/359

See application file for complete search history.

(56) References Cited

U.S. PATENT DOCUMENTS 2,058,583 A * 10/1936 Forss ..... 173/162.2
3,700,015 A * 10/1972 Kobayashi et al. ..... 83/859
3,968,843 A * 7/1976 Shotwell ..... 173/210
4,936,394 A 6/1990 Ohtsu (Continued)

FOREIGN PATENT DOCUMENTS

DE 151893 A * 11/1981

(Continued)

*Primary Examiner*—M. Rachuba
(74) *Attorney, Agent, or Firm*—Michael J. Striker

(57) ABSTRACT

A handheld power tool, in particular a handheld right-angle grinder (10), has an electric motor drive for a motor housing (11) that accommodates a tool and also has a handle (15), which is retained on the motor housing (11) by means of a handle mounting device (30) located between them, which handle mounting device has a mount (40), fastened to the motor housing (11), and at least one vibration-damping element (50) that is in communication with the mount (40) and the handle (15). The handle mounting device (30) has a mounting plate (60), on which the handle (15) is fastened by means of a fixation device. The at least one vibration-damping element (50) is located between the mount (40) and the mounting plate (60) and is solidly joined to them to form a unitary component. Fastening members (70) engaging the mount (40) are provided, which fix the mount (40) to the motor housing (11) and are provided with securing elements (71) that are free-standing relative to the mounting plate (60) and that, if the vibration-damping element (50) is torn, firmly retain the mounting plate (60) along with the handle (15) mounted on it (FIG. 1).

13 Claims, 4 Drawing Sheets

U.S. PATENT DOCUMENTS 5,052,500 A * 10/1991 Ohtsu ..... 173/162.2
5,361,500 A * 11/1994 Naslund et al. ..... 30/381
5,466,183 A * 11/1995 Kirn et al. ..... 451/359
5,681,214 A 10/1997 Kleider et al.
5,697,456 A * 12/1997 Radle et al. ..... 173/162.2
5,881,822 A * 3/1999 Sienkiewycz et al. ... 173/162.2
6,220,367 B1 * 4/2001 Masterson et al. ..... 173/162.2
6,375,171 B1 * 4/2002 Zimmermann et al. ..... 267/137
2005/0224244 A1 * 10/2005 Kraenzler et al. ..... 173/162.1

FOREIGN PATENT DOCUMENTS

DE 39 13 971 A1 11/1989
DE 41 02 838 A1 8/1992
DE 195 46 328 6/1997
DE 100 29 536 12/2001
EP 0 336 627 A2 10/1989

* cited by examiner

HAND-OPERATED MACHINE-TOOL COMPRISING A VIBRATION-DAMPING ROTARY HANDLE

CROSS-REFERENCE

The invention described and claimed hereinbelow is also described in PCT/DE 03/02509, filed Jul. 25, 2003 and DE 102 48 866.5, filed Oct. 18, 2002. This German Patent Application, whose subject matter is incorporated here by reference, provides the basis for a claim of priority of invention under 35 U.S.C. 119 (a)–(d).

BACKGROUND OF THE INVENTION

The invention is based on a handheld power tool, in particular a handheld right-angle grinder.

In a known handheld power tool of this kind (German Patent DE 39 13 971 C2), the handle is mounted on the motor housing of the handheld power tool by means of a handle mounting device located between them, which has a mount, in form of a tubular end piece with a protruding ring that is secured to the motor housing by means of screws. Moreover, there is at least one vibration-damping element in communication with the mount and the handle. The handle ends in a bell that fits over the mount, and the vibration-damping element is accommodated in the bell on both sides of the protruding ring of the mount in such a way that the vibration-damping element rests on one side on the ring of the mount and on the other on respective axial faces of the bell of the handle. The disposition is made such that the various vibration-damping elements prevent shifting of the handle relative to the mount. A desirable pivoting adjustability of the handle, as can be found for instance in German Patent Disclosure DE 41 02 838 A1 or DE 195 46 328 A1, is thus impossible in this instance.

SUMMARY OF THE INVENTION

The handheld power tool of the invention has the advantage over the prior art that virtually complete decoupling in terms of vibration between the handle and the motor housing is attained while the function of a pivotably adjustable handle is preserved, and that to the maximum possible extent, existing mass-produced components can continue to be used. Because of the special handle mounting device, secure manipulation of the handheld power tool is assured, while the at least one vibration-damping element is secured against damage, and a user handling the tool is protected against separation of the motor housing from the handle in the event of a defective vibration-damping element, for instance if it tears. Above all, a compact, economical, simple construction is obtained. The vibration-damping element of the handle mounting device can be seen from the outside in the handheld power tool, and thus it can also be seen whether the handle mounting device is or is beginning to become defective.

BRIEF DESCRIPTION OF THE DRAWINGS

The invention will be described in further detail in the ensuing description in conjunction with an exemplary embodiment shown in the drawing. Shown are.

DETAILED DESCRIPTION OF THE PREFERRED EMBODIMENTS

Figure 1:
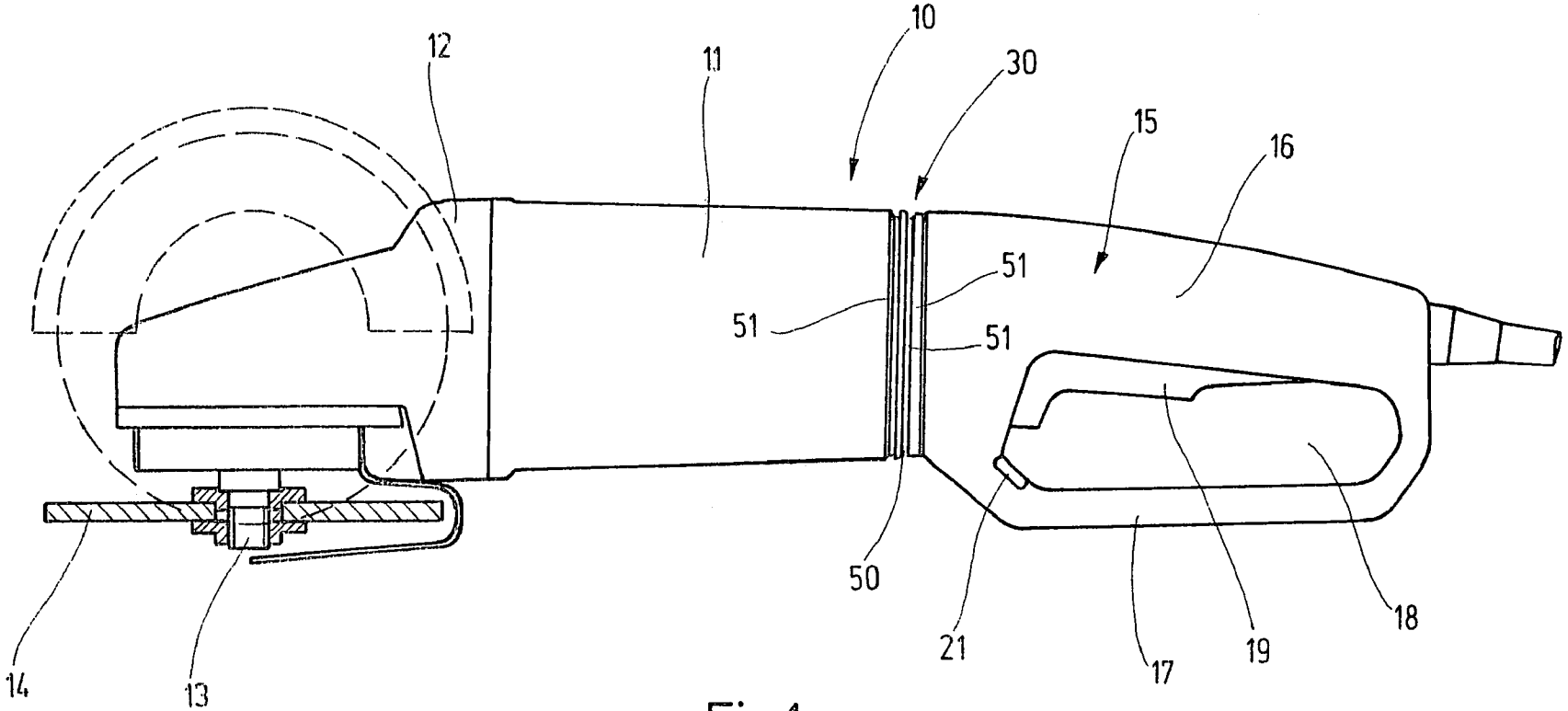
FIG. 1, a schematic side view of a handheld electric right-angle grinder.

The handheld electric right-angle grinder 10 schematically shown in FIG. 1, as an exemplary embodiment for a handheld power tool in general, has a motor housing 11, on one face end of which a gear head 12 with a protruding drive spindle 13 for a grinding wheel 14 is fixedly located, and on whose other face end a handle 15 is located pivotably adjustably along the longitudinally extending center axis of the motor housing 11 and covers the face end of the motor housing 11 in an at least largely dust-proof fashion. The handle 15 comprises a stock 16 which the user grasps with his hand in working with the right-angle grinder 10, and a hoop 17 integrally attached to the stock, which on the underside covers the stock 16, leaving an opening 18 the user can reach through, and when the user is working with the right-angle grinder 10 protectively covers the user's fingers, wrapped around the stock 16, from the bottom. On the underside of the stock 16 oriented toward the hoop 17, a switch panel 19 extends into the opening 18, which actuates an on-off switch for an electric drive motor that is accommodated in the motor housing 11. The handle 15, which is the main handle, is pivotably adjustably fixed to the motor housing 11 by means of a fixation device, not shown in further detail, in such a way that between the motor housing 11 and the handle 15, at least three different relative pivoted positions are possible, by pivoting about the longitudinal center axis of the motor housing 11. In the relative position of the motor housing 11 and handle 15 shown in FIG. 1, the right-angle grinder 10 is used for so-called roughing or grinding. In this relative position, the grinding wheel 14 extends substantially parallel to the switch panel 19. By pivoting the handle 15 or motor housing 11 90° to the left or right, the right-angle grinder 10 can be moved out of this roughing position and prepared for the "cutting" operation. In this working position of the right-angle grinder 10, the handle 15 stays in the same position while the motor housing 11 along with the gear head 12 is pivoted 90°, so that the grinding wheel 14 assumes the position shown in dashed lines in FIG. 1, in which the grinding wheel 14 can now function as a cutting wheel. The release of the fixation device is done by means of an actuating member 21 shown in suggested fashion. Details of the fixation device that is not shown and of the relative pivoting adjustment between the motor housing 11 and the handle 15 can be found for instance in German Patent Disclosure DE 195 46 328 A1, which is expressly incorporated by reference.

It can be seen from FIG. 1 that the handle 15 is held on the motor housing 11 by a handle mounting device 30 located between them. The handle mounting device has a mount 40, fastened in the region of the face end of the motor housing 11, and at least one vibration-damping element 50 that is in communication with the mount 40 and the handle 15. The handle mounting device 30 also has a mounting plate 60, to which the handle 15 is fastened by means of the aforementioned fixation device, for instance in accordance with DE 195 46 328 A1. The at least one vibration-damping element 50 is located, viewed in the direction of the longitudinal center axis of the motor housing 11, between the mount 40 and the mounting plate 60 and is solidly connected to both to form a unitary component. The mount 40 and/or the mounting plate 60 is formed of plastic, for instance, and in particular is embodied as a plastic injection-molded part. The solid connection of the mount 40 and the mounting plate 60 to the vibration-damping element 50 located between them is preferably done by vulcanizing or similar adhesive bonding, and in any case such that the mount 40, the vibration-damping element 50 and the mounting plate 60 are solidly joined into a unitary component in such a way that this component can transmit forces in the axial direction as well as transversely to it; vibration generated by the vibration-damping element 50 when the right-angle grinder 10 is on and in work done with the right-angle grinder are damped in such a way that they are kept as far away as possible from the handle 15 and the user. Thus the vibration-damping element 50 brings about a decoupling of vibration between the handle 15 on the one hand and the motor housing 11 on the other, with all the elements of the right-angle grinder 10 contained in and connected to the motor housing.

The at least one vibration-damping element 50 comprises an elastomer and is embodied as an annular part, which on its outer circumferential region has three axially spaced-apart ribs 51 extending all the way around, and between them, radially indented grooves 52 that are open toward the outside. The vibration-damping element 50 can be damaged by the loads that occur in operation and broken, for instance, or more specifically torn from either the mount 40 or the mounting plate 60 or both, or at some other point. In that event, the part of the right-angle grinder that is seated on the handle 15 by means of the handle mounting device would become detached from the handle 15. A user working with the right-angle grinder 10 could be injured in the process. Still other damage could also be caused. This is counteracted by providing security against failure of the vibration-damping element 50; the handle mounting device 30 is designed such that virtually complete vibrational decoupling along with a compact, economical, simple construction are attained, and the mass-produced function of the rotatable or pivotably adjustable handle 15 is still possible, with extensive continued used of mass-produced components. Safe and secure handling of the right-angle grinder 10 is thus assured. This is attained not only by the handle mounting device 30 in the manner described but also because of the fact that fastening members 70 that engage the mount 40 fix the mount 40 to the motor housing 11 and are provided with securing elements 71 which are free-standing relative to the mounting plate 60 are provided, which during normal operation are free-standing relative to the mounting plate 60 but if the vibration-damping element 50 becomes damaged, for instance if it is torn, they firmly hold the mounting plate 60 and by way of it the handle 15 mounted on it in such a way that the part of the right-angle grinder 10 fixed on the handle 15 via the handle mounting device 30 remains on it in the event of such damage, and when work is done, the user-exerted forces can continue to be transmitted via the handle mounting device 30. Since the fastening members 70 fix the mount 40 on the motor housing 11, the secure hold of the mount 40 on the motor housing 11 is assured. Since if the vibration-damping element 50 fails, the securing elements 71 of the fastening members 40 then come to rest on the mounting plate 60, the detachment of the handle 15 from the motor housing 11 is thus prevented.

Figure 3:
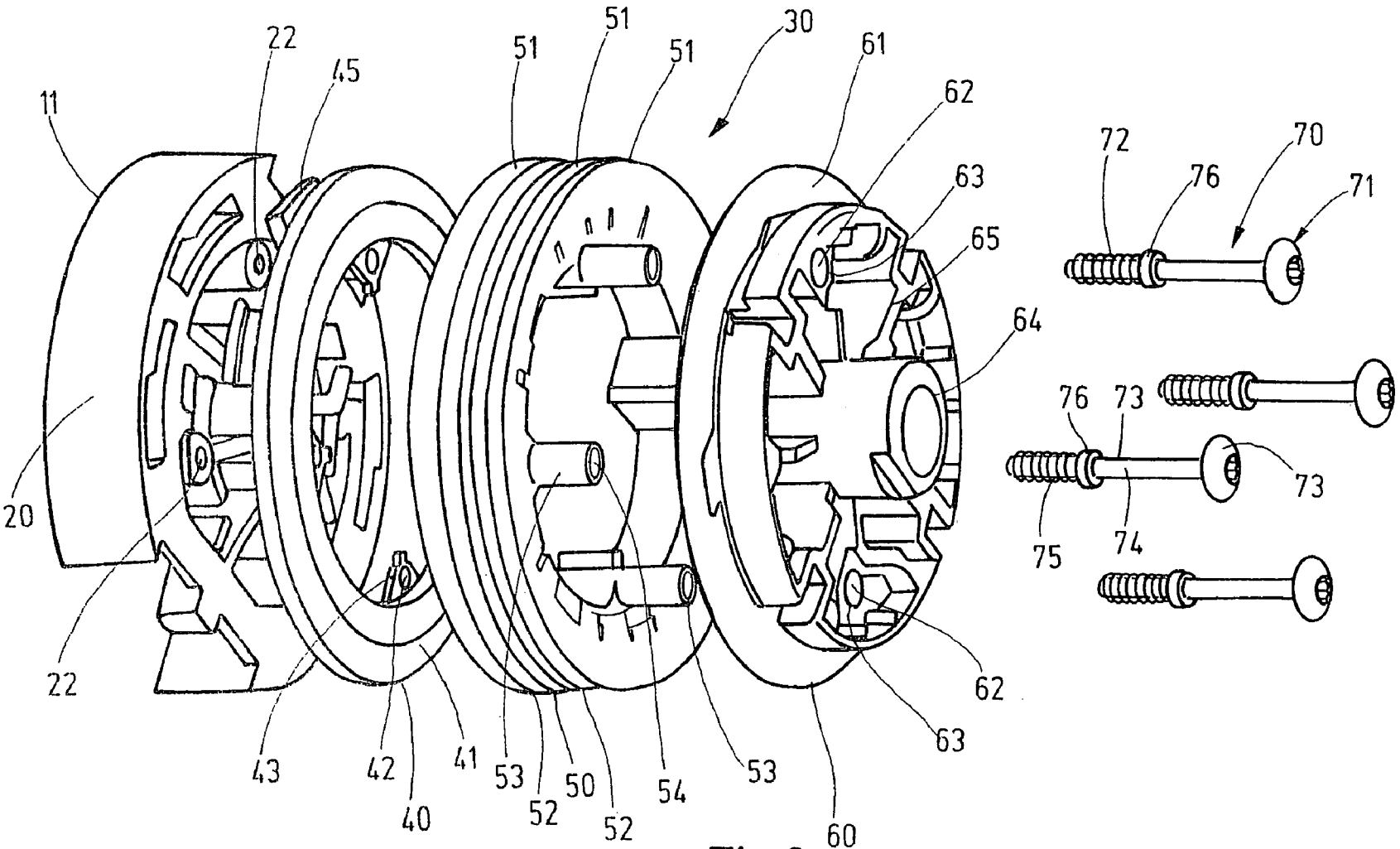
FIG. 3, a perspective exploded view of the handle mounting device of FIG. 2.
Figure 4:
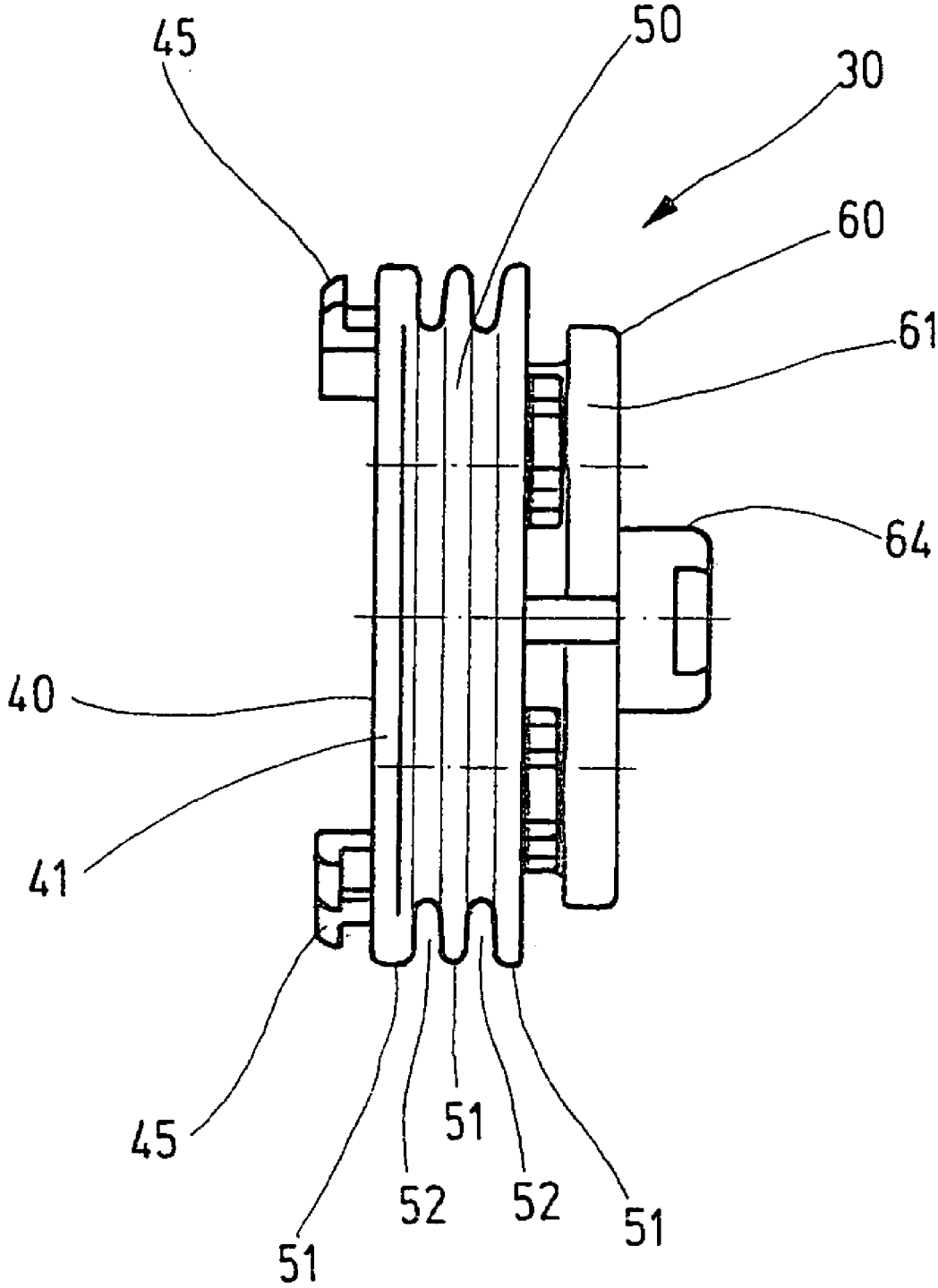
FIG. 4, a schematic side view of the handle mounting device of FIGS. 2 and 3.

The fastening members 70 penetrate the unitary component that is formed of the mount 40, vibration-damping element 50 and mounting plate 60, and with one end 72 they engage the motor housing 11. These ends 72 engage sleeves 22, for instance, schematically indicated in FIG. 3, in a part 20 of the motor housing 11. The fastening members 70 advantageously comprise screws 73, whose shaft 74 is provided, in a section on the left in FIG. 3, with a thread, for instance a self-tapping thread, and has a stop part 76, in particular in the form of a collar, on the end of this threaded portion, with which stop part the various screws 73 engage the mount 40 and firmly clamp it to the motor housing 11. The securing elements 71 comprise a screw head 77 on the end. In the exemplary embodiment shown, the handle mounting device 30 has four such securing elements 71, which are spaced apart from one another by substantially equal circumferential angles.

The mount 40 is formed from a ring 41, which has eyelets 43 which are provided with passages 42 for the fastening members 70, in particular screws 73, and on which eyelets the respective stop part 76, in particular the collar, rests, in such a way that the mount 40 is axially firmly clamped on the motor housing 11, in particular on its part 20. The mount 40 is armored with a metal part 44, in particular a metal ring, which forms the eyelets 43 with the passages 42 in them. The mount 40 is formed of plastic, for instance, and the metal part 44 is injected into it. This improves the secure hold of the mount 40 on the motor housing 11 still further. Moreover, the mount 40, in particular the ring 41, has bayonet hooks 45, which as an additional fastening of the mount 40 can likewise engage the motor housing 11. This creates additional security against failure.

The mounting plate 60 is embodied as an approximately circular disk 61, which has passages 62, aligned with the passages 42 of the mount 40, for the fastening members 70, in particular screws 73. On the side facing away from the vibration-damping element 50, the mounting plate 60 is provided, in the region of the passages 62, with eyelets 63 which may be formed by the end face regions surrounding the passages 62. If the vibration-damping element 50 fails, for instance being torn, then the securing elements 71 that otherwise during normal operation are free-standing, in the form of the screw heads 77, can come axially into contact with the eyelets 63 of the mounting plate 60, so that despite the torn-off vibration-damping element 50, the mounting plate 60 continues to be held on the mount 40 and by way of it on the motor housing 11. The inside diameter of the passages 62 in the mounting plate 60 is selected to be at least as great as the diameter of the respective stop part 76 in the form of the collar of the fastening members 70, so that for fastening the handle mounting device 30 to the motor housing 11, the fastening members 70, in particular screws 73, can be inserted through the passages 62 and 42, to the left in terms of FIG. 3, far enough that with the stop part 76 in the form of the collar, they axially strike the respective eyelets 43 of the mount 40.

On the side facing away from the vibration-damping element 50, the mounting plate 60, as parts of the aforementioned fixation device for the handle 15, has an only schematically indicated central bearing journal 64 and/or a live ring 65, which serve the purpose of pivotably adjustable fastening of the handle 15 on the mounting plate 60.

On the side toward the mounting plate 60, the vibration-damping element 50 has sleeve portions 53, which are tubular and extend into the passages 62 in the mounting plate 60, approximately as far as the eyelets 63, thus filling up the passages 62. The sleeve portions 53 include passages 54 in them that are aligned with the passages 42 in the mount 40 that are provided in the metal part 43 of the mount.

Figure 2:
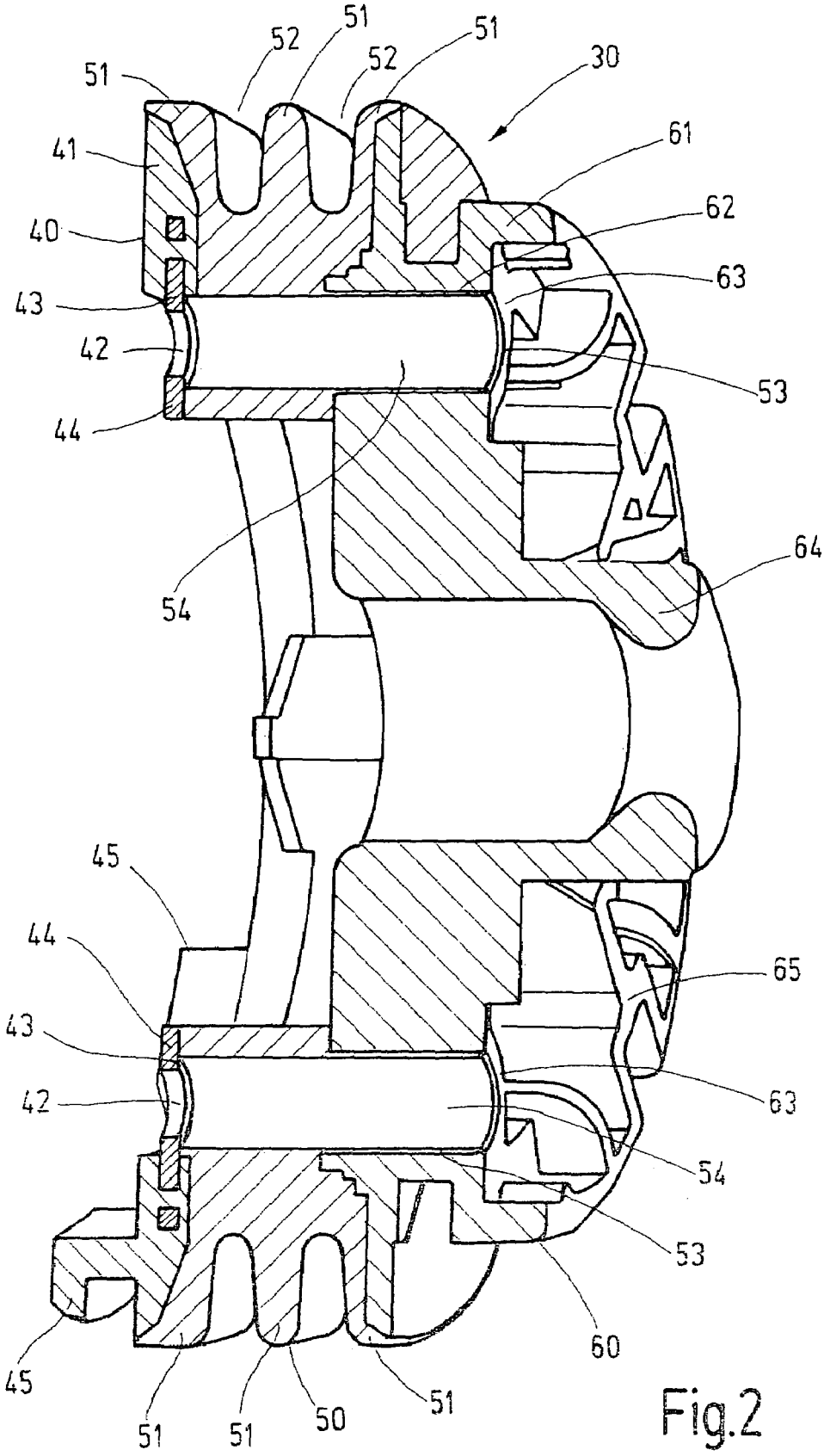
FIG. 2, a perspective view, partly in section, of a handle mounting device of the right-angle grinder of FIG. 1.

As can be seen particularly from FIG. 2, with the rib 51 axially adjoining the mount 40 on one side and the mounting plate 60 on the other, the vibration-damping element 50 covers the mount 40 as well as that part of the mounting plate 60 adjoining the vibration-damping element 50 in the region of the outer circumferential surfaces of the outer edges of both the mount 40 and the mounting plate 60. As a result, in the installed state shown in FIG. 1, only the outer circumferential surface of the vibration-damping element 50 extends to the outside and is visible. In this way, good sealing of the faces of material is attained between the handle mounting device 30 on the one hand and the motor housing 11 and handle 15 on the other. Moreover, this produces an attractive exterior.

What is claimed is:

1. A handheld power tool, in particular a handheld right-angle grinder (10), having a motor housing (11), which accommodates an electric motor drive for a tool, in particular for a grinding or cutting wheel (14), and having a handle (15), which is retained on the motor housing (11) by means of a handle mounting device (30) located between them, which handle mounting device has a mount (40), secured to the motor housing (11), and at least one vibration-damping element (50) that is in communication with the mount (40) and the handle (15), wherein the handle mounting device (30) has a mounting plate (60), to which the handle (15) is fastened by means of a fixation device; the at least one vibration-damping element (50) is located between the mount (40) and the mounting plate (60) and is solidly joined to both of them to form a unitary component; and fastening members (70) engaging the mount (40) fix it to the motor housing (11), wherein each fastening member (70) passes through the unitary component and penetrates a passage (62) in the mounting plate (60), a passage (54) in the vibration-damping element (50), and a passage (42) in the mount (40), wherein all of the passages (62,54,42) are aligned with one another, wherein each fastening member (70) engages with one end (72) the motor housing (11, 20) and has a stop part (76) formed as a collar on its shaft (74), wherein said stop part (76) engages the mount (40) and firmly clamps the mount (40) against the motor housing (11, 20), wherein each fastening member (70) comprises a securing element (71) in the form of a screw head (77) on its other end, wherein said securing element (71) is free-standing relative to the mounting plate (60) during normal operation, but if the vibration-damping element (50) is defective, for instance if it is torn, firmly holds the mounting plate (60) and by way of it the handle (15) and the motor housing (11) together.

2. The handheld power tool as recited claim 1, wherein the fastening members (70) are embodied as screws (73).

3. The handheld power tool as recited in claim 1, wherein the mount (40) is formed as a ring (41), which has eyelets (43) which are provided with said passages (42) for the fastening members (70), and on which eyelets the respective stop part (76) rests.

4. The handheld power tool as recited in claim 1, wherein the mount (40) is armored with a metal part (44), in particular a metal ring, that forms the eyelets (43).

5. The handheld power tool as recited in claim 4, wherein the mount (40) is formed of plastic, and the metal part (44) is injected into it.

6. The handheld power tool as recited in claim 1, wherein the mount (40) has bayonet hooks (45), which, as an additional fastening of the mount (40), engage the motor housing (11,20).

7. The handheld power tool as recited in claim 1, wherein the mounting plate (60) is embodied as an approximately circular disk, which has said passages (62), aligned with the passages (42) of the mount (40), for fastening members (70) and on the side facing away from the vibration-damping element (50), in the region of the passages (62), has eyelets (63) with which the securing elements (71) are able to come into axial contact.

8. The handheld power tool as recited in claim 1, wherein the inside diameter of said passages (62) in the mounting plate (60) is dimensioned to be at least as great as the diameter of the respective stop part (76) of the fastening members (70).

9. The handheld power tool as recited in claim 1, wherein on the side facing away from the vibration-damping element (50), the mounting plate (60) has a central bearing journal (64) and/or a live ring (65) as parts of the fixation device for the handle (15) for pivotably adjustable fastening of the handle (15).

10. The handheld power tool as recited in claim 1, wherein the mounting plate (60) is embodied as a plastic part.

11. The handheld power tool as recited in claim 1, wherein the vibration-damping element (50) is embodied as an annular part of an elastomer and is joined to the mount (40) and the mounting plate (60) by vulcanization or similar adhesive bonding.

12. The handheld power tool as recited in claim 1, wherein the vibration-damping element (50), on the side toward the mounting plate (60), has sleeve portions (53) with said passages (54) therein, the sleeve portions reaching into said passages (62) of the mounting plate (60) and being aligned with the passages (42) of the mount (40).

13. The handheld power tool as recited in claim 1, wherein the vibration-damping element (50) covers the mount (40) and/or at least part of the mounting plate (60) in the region of the outer circumferential surface of the respective outer edge.

* * * * *